US011274433B2

(12) United States Patent
Britton et al.

(10) Patent No.: US 11,274,433 B2
(45) Date of Patent: Mar. 15, 2022

(54) LINKABLE TILES FOR COVERING A SURFACE

(71) Applicants: Jeremy Britton, Riverside, CA (US); Jacob Olsson, Riverside, CA (US); Domanic Chu, Alhambra, CA (US)

(72) Inventors: Jeremy Britton, Riverside, CA (US); Jacob Olsson, Riverside, CA (US); Domanic Chu, Alhambra, CA (US)

( * ) Notice: Subject to any disclaimer, the term of this patent is extended or adjusted under 35 U.S.C. 154(b) by 0 days.

(21) Appl. No.: 16/928,945

(22) Filed: Jul. 14, 2020

(65) Prior Publication Data

US 2021/0148108 A1 May 20, 2021

Related U.S. Application Data

(63) Continuation-in-part of application No. 16/879,659, filed on May 20, 2020, which is a continuation-in-part of application No. 16/736,371, filed on Jan. 7, 2020, now Pat. No. 10,711,467.

(60) Provisional application No. 62/936,470, filed on Nov. 16, 2019.

(51) Int. Cl.

| | |
|---|---|
| ***E04F 15/02*** | (2006.01) |
| ***E04B 1/41*** | (2006.01) |
| ***E04B 1/61*** | (2006.01) |

(52) U.S. Cl.

CPC ..... *E04B 1/40* (2013.01); *E04B 1/54* (2013.01); *E04F 15/02* (2013.01); *E04F 2201/0529* (2013.01); *E04F 2201/06* (2013.01); *Y10T 428/17* (2015.01)

(58) Field of Classification Search

None

See application file for complete search history.

(56) References Cited

U.S. PATENT DOCUMENTS

| | | | |
|---|---|---|---|
| 4,561,232 | A | 12/1985 | Gladden, Jr. et al. |
| 5,411,262 | A | 5/1995 | Smith |
| 9,181,717 | B1 | 11/2015 | Jamison |
| 9,890,540 | B2 | 2/2018 | Weitzer |
| 10,208,489 | B2 | 2/2019 | Walens et al. |
| 10,258,896 | B2 | 4/2019 | Ornstein et al. |
| 2002/0170259 | A1 | 11/2002 | Ferris |
| 2005/0166513 | A1 | 8/2005 | Vanderhoef |
| 2008/0202053 | A1 | 8/2008 | Guy et al. |
| 2008/0213529 | A1 | 9/2008 | Gray et al. |

(Continued)

FOREIGN PATENT DOCUMENTS

| | | | |
|---|---|---|---|
| CN | 101260729 | A | 9/2008 |
| CN | 102146726 | A | 8/2011 |

(Continued)

OTHER PUBLICATIONS

Machine translation of JP20-2013-0000650 (Year: 2021).*

(Continued)

*Primary Examiner* — Alexander S Thomas

(74) *Attorney, Agent, or Firm* — Umberg Zipser LLP

(57) ABSTRACT

Various embodiments of interconnectable pieces are described that collectively form a surface. The pieces comprise one or more routed edges or cutouts that can be configured to receive an insert used to couple adjacent tiles to one another. Some inserts may comprise one or more magnets or magnetized portions to magnetically couple the pieces with adjacent pieces.

6 Claims, 9 Drawing Sheets

(56) References Cited

U.S. PATENT DOCUMENTS

| | | | |
|---|---|---|---|
| 2014/0227934 | A1 | 8/2014 | Rudisill |
| 2016/0340912 | A1 | 11/2016 | Norris |
| 2019/0013131 | A1 | 1/2019 | Smith et al. |

FOREIGN PATENT DOCUMENTS

| | | | |
|---|---|---|---|
| CN | 203271063 | U | 11/2013 |
| CN | 206487110 | U | 9/2017 |
| CN | 108517976 | A | 9/2018 |
| GB | 2564104 | A | 1/2019 |
| JP | 2001349559 | A | 12/2001 |
| KR | 2020110010826 | U | 11/2011 |
| KR | 200461450 | Y1 | 7/2012 |
| KR | 2020130000650 | U | 1/2013 |
| KR | 101330389 | B1 | 11/2013 |
| KR | 200469749 | Y1 | 11/2013 |
| WO | 2018195002 | A1 | 10/2018 |

OTHER PUBLICATIONS

Korea Intellectual Property Office, International Search Report and Written Opinion, dated Feb. 26, 2021.
Korea Intellectual Property Office, International Search Report and Written Opinion, dated Aug. 13, 2020.
China Patent Office, First Office Action, dated Dec. 3, 2021.

* cited by examiner

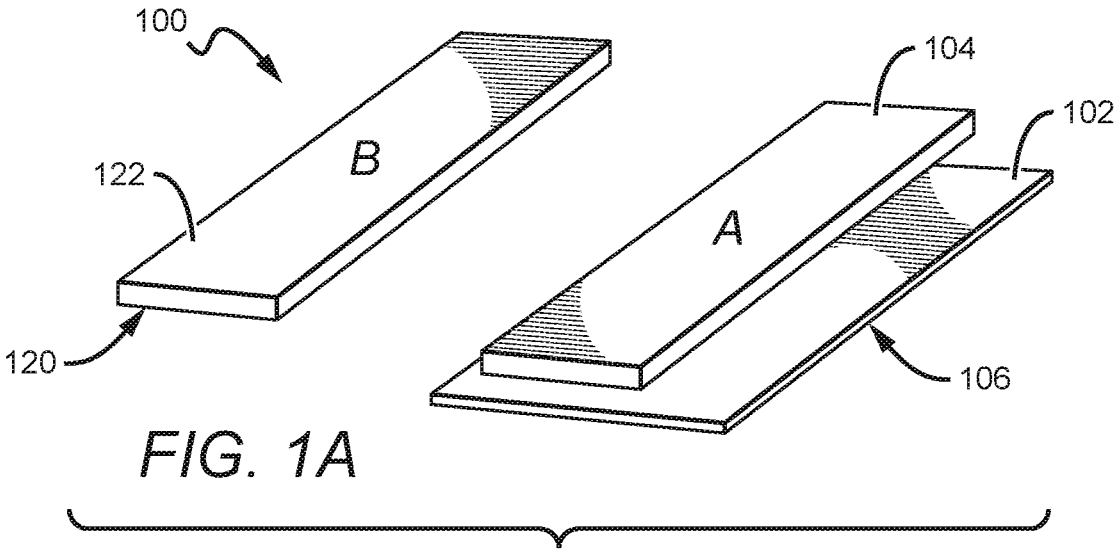
FIG. 1A
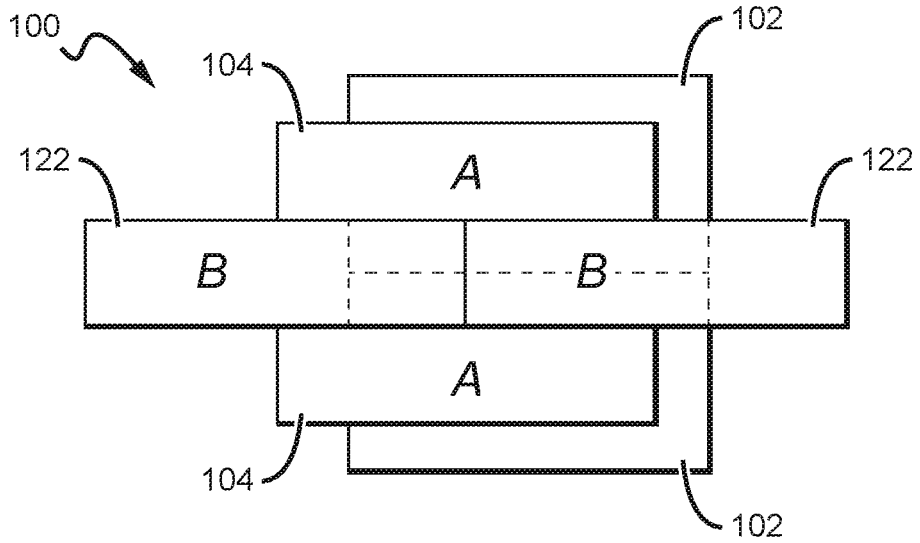
FIG. 1B
FIG. 1C
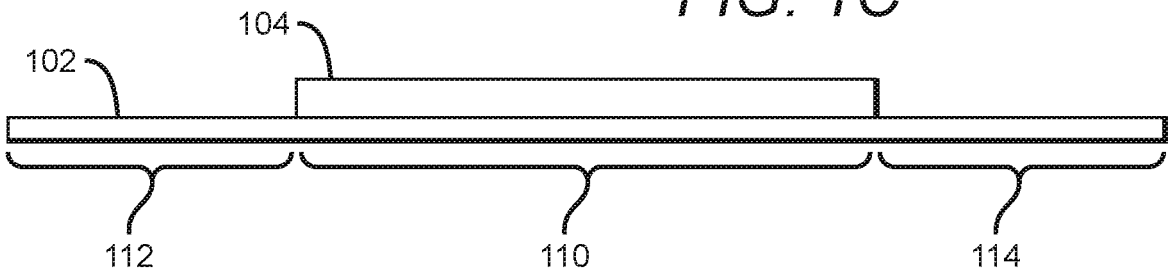

FIG. 3A
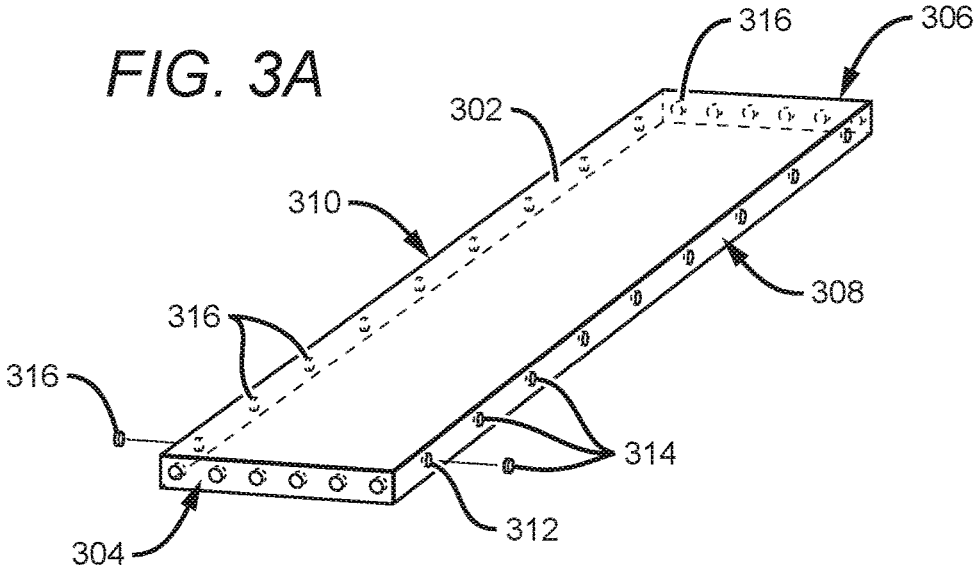
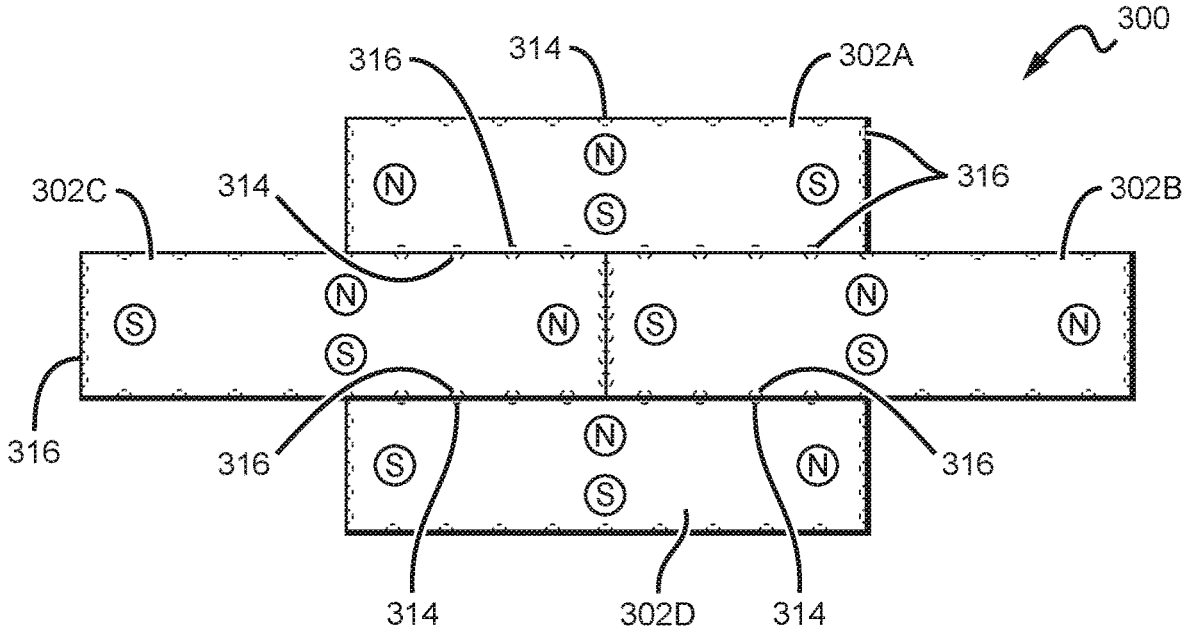
FIG. 3B
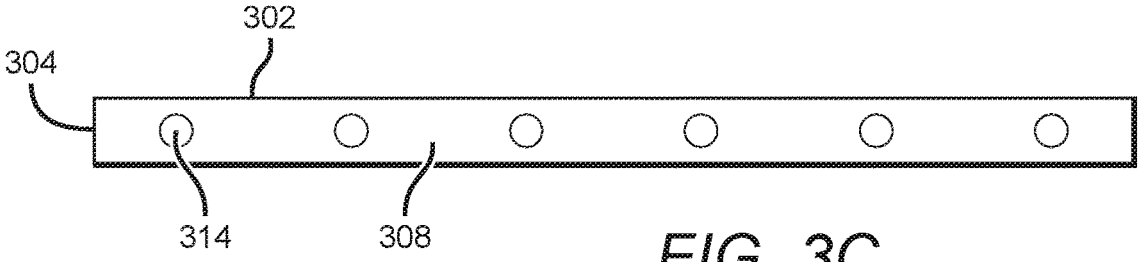
FIG. 3C

FIG. 9A
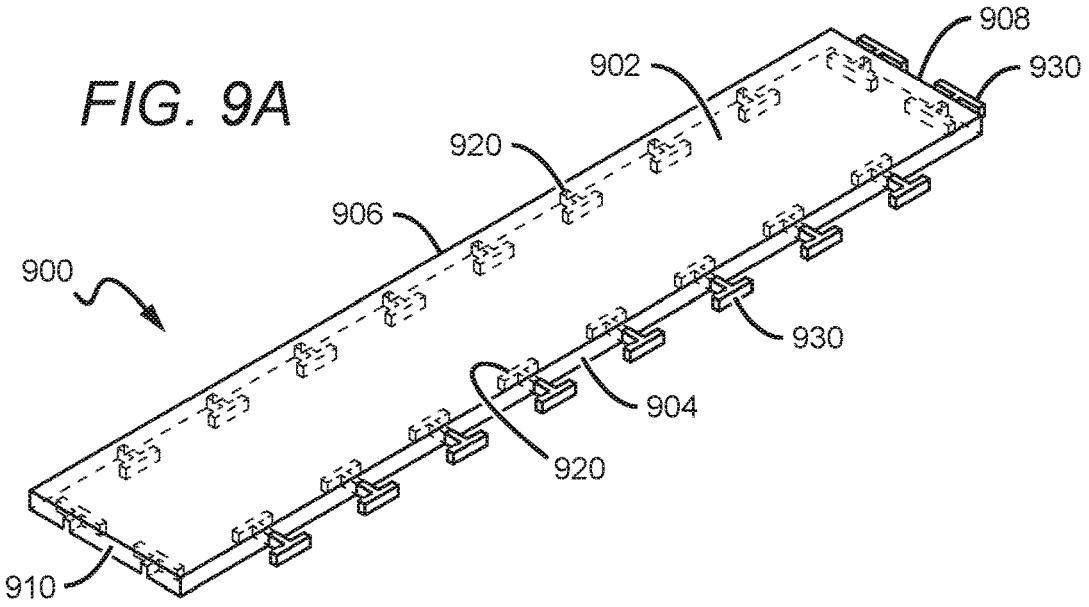
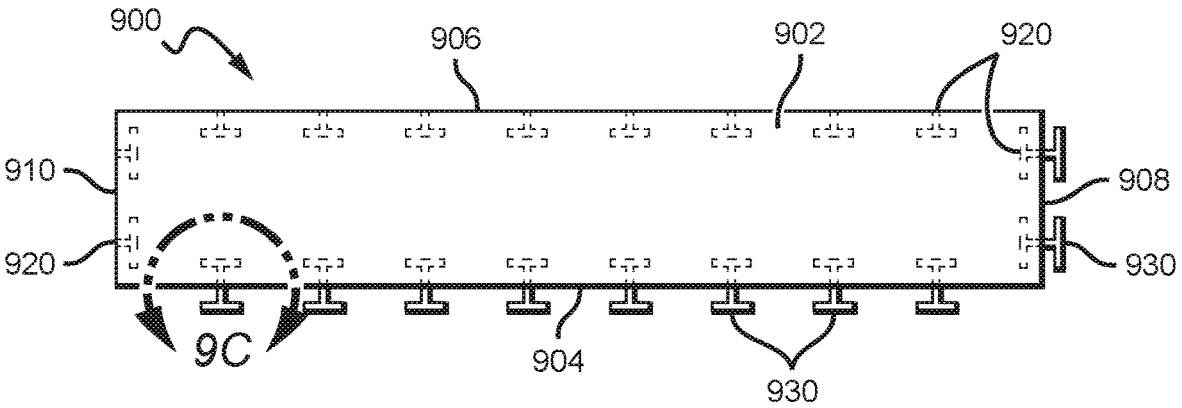
FIG. 9B
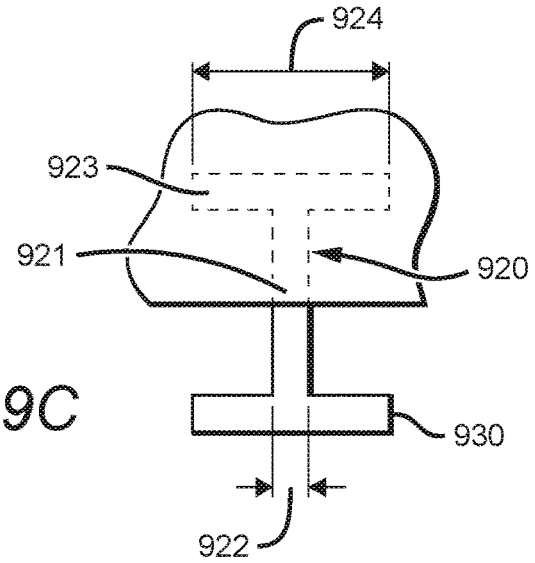
FIG. 9C

LINKABLE TILES FOR COVERING A SURFACE

This application is a continuation-in-part application of U.S. non-provisional application having Ser. No. 16/879,659 filed on May 20, 2020, which is a continuation-in-part application of U.S. non-provisional application having Ser. No. 16/736,371 filed on Jan. 7, 2020 now U.S. Pat. No. 10,711,467, which itself claims priority to U.S. provisional application having Ser. No. 62/936,470 filed on Nov. 16, 2019. These and all other referenced extrinsic materials are incorporated herein by reference in their entirety. Where a definition or use of a term in a reference that is incorporated by reference is inconsistent or contrary to the definition of that term provided herein, the definition of that term provided herein is deemed to be controlling.

FIELD OF THE INVENTION

The field of the invention is interlocking tiles.

BACKGROUND

The following description includes information that may be useful in understanding the present invention. It is not an admission that any of the information provided herein is prior art or relevant to the presently claimed invention, or that any publication specifically or implicitly referenced is prior art.

In general, flooring tiles and other interlocking tiles comprise a first side with routed edges that are used to interlock adjacent tiles by holding the adjacent tile against the other tile at a slight angle and then pushing the adjacent tile to lock the two tiles together. This solution can prevent quick removal of a single piece of the interlocked tiles due to the nature of each tile being interlocked with neighboring tiles.

All publications identified herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

Thus, there is still a need for linkable tiles having improved mechanisms for linking adjacent tiles.

SUMMARY OF THE INVENTION

The inventive subject matter provides apparatus, systems and methods for tiles for covering a surface. In preferred embodiments, a set of tiles are coupled together to form a covering for a surface onto which they are laid. Such surface could comprise a floor but could alternatively comprise a wall or other surface. As used herein, the term "tile" is defined to include planks and other pieces that can be interconnected to form a covering for a floor, wall or other surface. Tiles can therefore include, for example, composite flooring such as luxury vinyl flooring or other engineered flooring that may have multiple layers and/or materials and solid surface flooring, and could be formed from one or more materials such as wood, metals, fiberglass, and so forth.

In some embodiments, the tile comprises a composite piece disposed on top of a vinyl sheet and attached to one another. Preferably, a surface area of the vinyl sheet is greater than a surface area of the composite piece. The composite piece is disposed on top of the vinyl sheet in an offset manner, such that a portion of the composite piece is disposed off of the vinyl sheet. At least one of the vinyl sheet and composite piece comprises a magnetized portion.

In preferred embodiments, a portion of the vinyl sheet, and preferably not the portion beneath the composite sheet, comprises the magnetized portion. In this manner, two of these tiles can be placed such that the vinyl sheet of each abuts on one side. A second tile having a set of magnets on a lower surface of the second tile can be placed on at least part of the magnetized portion of the vinyl sheet of each of the two tiles. In this manner, the magnets on the lower surface of the second tile can be coupled to the adjacent vinyl sheets such that the three tiles are coupled with the second tile disposed in between the two other tiles.

In another embodiment, the tile comprises first, second, third and fourth sides, with the first and second sides disposed opposite of each other, and the third and fourth sides disposed opposite of each other. In such embodiment, the third and fourth sides are disposed between the first and second sides. The first side preferably comprises a first routed edge having a first slot with first and second opposing inner edges, such that a width of an inner surface of the first slot is greater than a width of an opening of the first slot in the first side.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWINGS

FIGS. 1A-1C illustrate various views of one embodiment of a piece.

FIGS. 3A-3C illustrate various views of another embodiment of a piece.

FIGS. 9A-9C illustrate various views of another embodiment of a piece.

DETAILED DESCRIPTION

Figure 2A:
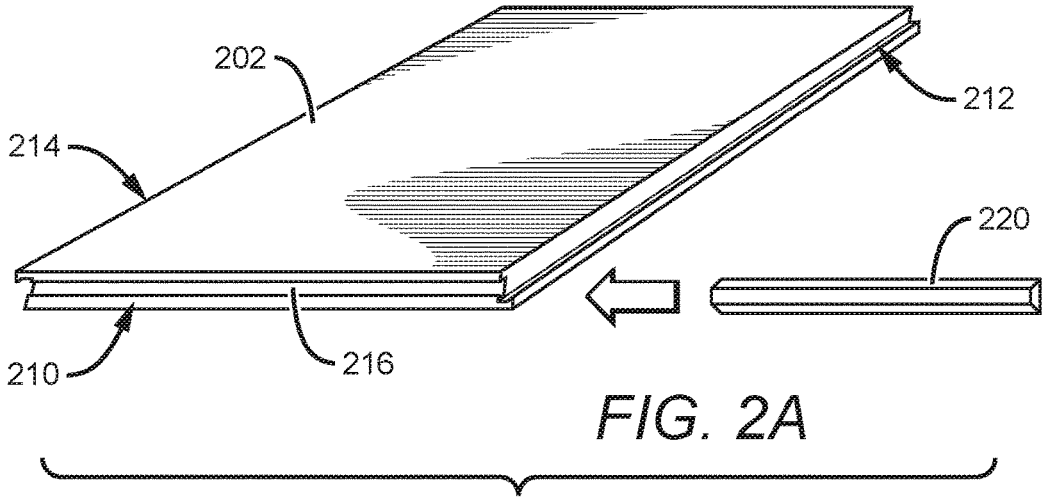
FIGS. 2A-2C illustrate various views of another embodiment of a piece.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

FIGS. 1A-1C illustrate one embodiment of a flooring system 100 for covering a floor or other surface that comprises a first set of tiles A and a second set of tiles B. Although referred to as a flooring system, it is contemplated that the tiles could be used to cover a wall or other surface in addition to flooring.

The first set of tiles A comprises a composite piece 104 that is disposed on top of a vinyl sheet 102. Preferably, a surface area of the vinyl sheet 102 is greater than a surface area of the composite piece 104. It is especially preferred that the composite piece 104 is disposed on top of the vinyl sheet 102 in an offset manner, such that a portion of the composite piece 104 is disposed off the vinyl sheet 102, such as shown in FIG. 1A.

It is preferred that at least one of the vinyl sheet 102 and composite piece 104 comprises a magnetized portion. In the embodiment shown in FIGS. 1A-1C, at least a portion of the vinyl sheet 102 is preferably magnetized to form the magnetized portion 106, and such portion is preferably the portion that is not disposed beneath composite piece 104. Thus, in such embodiments, the vinyl sheet 102 can comprise a first region 110 and a second region 112, wherein the composite piece 104 is disposed on top of the first region 110 and not the second region 112, and wherein the second region 112 comprises the magnetized portion 106. It is contemplated that the vinyl sheet 102 may also comprise a third region 114 on an opposite side of the composite piece 104, which may or may not be magnetized.

However, it is also contemplated that one or more of the sides of the composite piece 104 could comprise one or more magnets.

As discussed above, system 100 can also include a second set of tiles B, which are configured to couple with the tiles A of the first set, such as shown in FIG. 1B. Preferably each tile B of the second set comprises a set of magnets on a lower surface 120. In this manner, the set of magnets on the lower surface 120 magnetically couple with the magnetized surface 106 of the vinyl sheet 102 to thereby couple tile B to tile A.

As shown in FIG. 1B, composite piece 122 of tile B can be placed between adjacent tiles A to thereby connect the three tiles via the intermediate tile B. The tiles A,B,A can be coupled together via the interaction between at least some of the magnets on the lower surface 120 of composite piece 122 and the magnetized portions 106 of the vinyl sheet 102 of tiles A. As shown, tiles B are preferably placed in an offset manner relative to the composite pieces 104 of tiles A.

Although not shown, it is contemplated that one or more sides of the composite piece 122 could have a routed edge that interacts with a routed edge of composite piece 104 to thereby further secure the composite pieces 122 and 104 to one another.

Figure 2B:
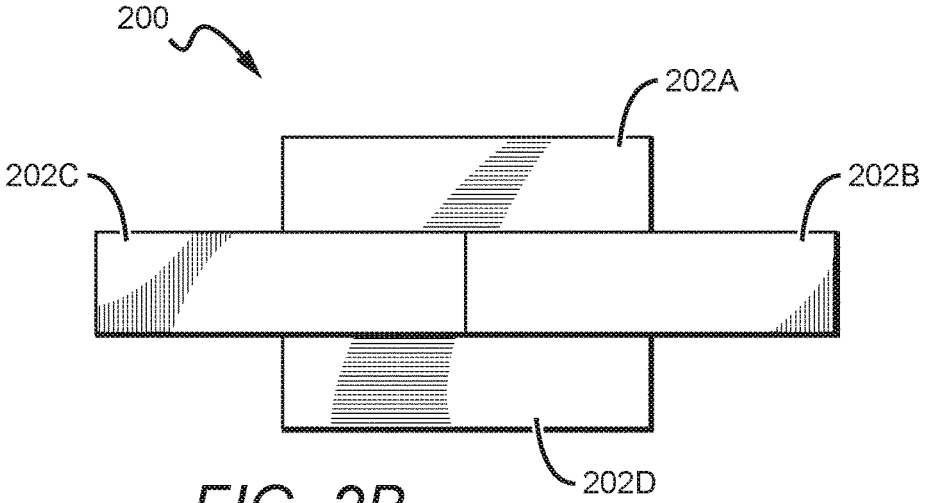
Figure 2C:
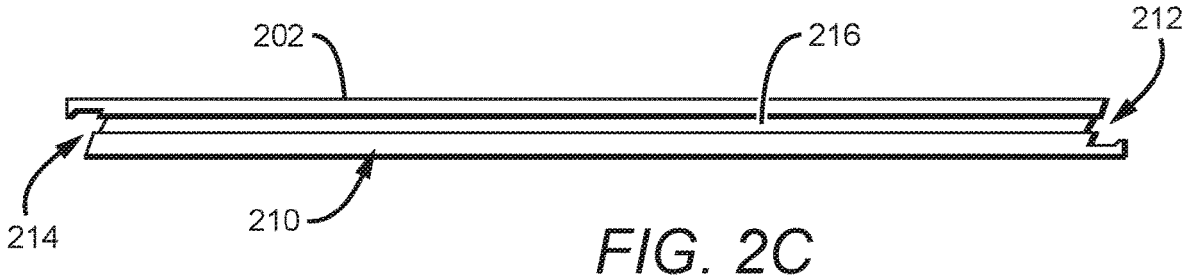

FIGS. 2A-2C illustrate another embodiment of a flooring system 200 for covering a floor or other surface that comprises a set of tiles 202. As shown in FIGS. 2A and 2C, each tile 202 comprises a composite piece having first, second, third and fourth sides forming a rectangular shape with the first and second sides disposed opposite of each other, and the third and fourth sides disposed opposite of each other. In such arrangement, the third side and fourth side are each disposed between the first and second sides. Of course, tile 202 could instead have three sides or five or more sides without departing from the scope of the invention herein.

The first side 210 comprises a routed edge having a slot 216 cut into the first side 210. The slot 216 preferably has first and second opposing sides that extend between an opening of the slot 216 on an outer surface of the first side 210 and an inner surface of the slot 216. A width or diameter of the inner surface of the slot 216 is preferably greater than a width or diameter of the opening of the slot 216.

As shown in FIGS. 2A and 2C, preferably the first and second opposing sides of slot 216 are tapered, such that a cross-section of the slot 216 comprises an isosceles trapezoid shape. In such embodiments, it is contemplated that the slot 216 is configured to receive an insert 220 having a set of magnets coupled to or embedded within the insert 220. Preferably, the insert 220 also comprise a cross-section having an isosceles trapezoid shape. In this manner, the insert 220 can be slidably engaged with the slot 216, and thereby held in place while providing magnets that be used to couple the side 210 of the tile 202 with an adjacent tile having one or more magnets or magnetized surface.

Alternatively, it is contemplated that the slot 216 could comprise a T-shape, an L-shape, or other suitable shape, such that a width or diameter of the inner surface of the slot 216 remains greater than a width or diameter of the opening of the slot 216.

Tile 202 can include a third side having a routed edge 212 and a fourth side having a routed edge 214. Preferably, the routed edge 212 is complementary to the routed edge 214, such that routed edge 214 of an adjacent tile can be connected with routed edge 212 of the tile 202. The adjacent tiles may be coupled in an interlocking manner where the edges are placed together and then moved relative to one another to lock the tiles in place. In such embodiments, it is contemplated that the insert 220 can be used to help prevent the side 210 of the tile 202 from raising or warping over time by the use of the magnetic coupling with an adjacent tile.

It is further contemplated that the second side (opposite of the first side 210) can have a routing to form a slot similar to that of slot 216, and that is configured to receive an insert much like insert 220. In this manner, two of the sides (first and second sides) can have a set of magnets or otherwise be magnetized, and the other two sides (third and fourth sides) can have a routed edge that permits interlocking of an adjacent tile.

As shown in FIG. 2B, multiple tiles 202A-202D can be connected to adjacent tiles to form a flooring. For example, tile 202A can be connected to tiles 202C and 202B via the routed edges of those tiles. Likewise, tile 202D can be connected to tiles 202C and 202B via the routed edges of those tiles. Tiles 202B and 202C can be magnetically coupled to one another via the inserts 220.

FIGS. 3A-3C illustrate another embodiment of a flooring system 300 for covering a floor or other surface that comprises a set of tiles 302. As shown in FIGS. 3A and 3C, each tile 302 comprises a composite piece having a first side 304, a second side 306, a third side 308, and a fourth side 310 forming a rectangular shape with the first and second sides 304, 306 disposed opposite of each other, and the third and fourth sides 308, 310 disposed opposite of each other. In such arrangement, the third side and fourth sides 308, 310 are each disposed between the first and second sides 304, 306. As discussed above, triangular shapes and other shapes are alternatively contemplated.

Each of the sides preferably comprises a set of recessed or notches configured to receive a magnet. Preferably, the magnets are arranged such that the first and third sides 304, 308 have a first polarity and the second and fourth sides 306, 310 have the opposite polarity. Thus, the first and third sides 304, 308 comprises a set of magnets 314 disposed such that the north pole of the magnets 314 face outwardly, and the second and fourth sides 306, 310 comprises a set of magnets 316 disposed such that the south pole of the magnets 316 face outwardly. Of course, the polarity of the magnets of the first and third sides 304, 308 could be swapped with the magnets of the second and fourth sides 306, 310 without departing from the scope of the invention.

As shown in FIG. 3B, multiple tiles 302A-302D can be connected to adjacent tiles to form a flooring. For example, tile 302A can be connected to tiles 302B and 302C via magnets 316 on the fourth side of the tile 302A, and magnets 314 on the second side of tiles 302B and 302C. Likewise, tile 302D can be connected to tiles 302B and 302C via magnets 314 on the second side of the tile 302D, and magnets 316 on the fourth side of tiles 302B and 302C. Tiles 302B and 302C can be magnetically coupled to one another via magnets 314 on the first side of tile 302C and magnets 316 on the second side of tile 302B.

Figure 4A:
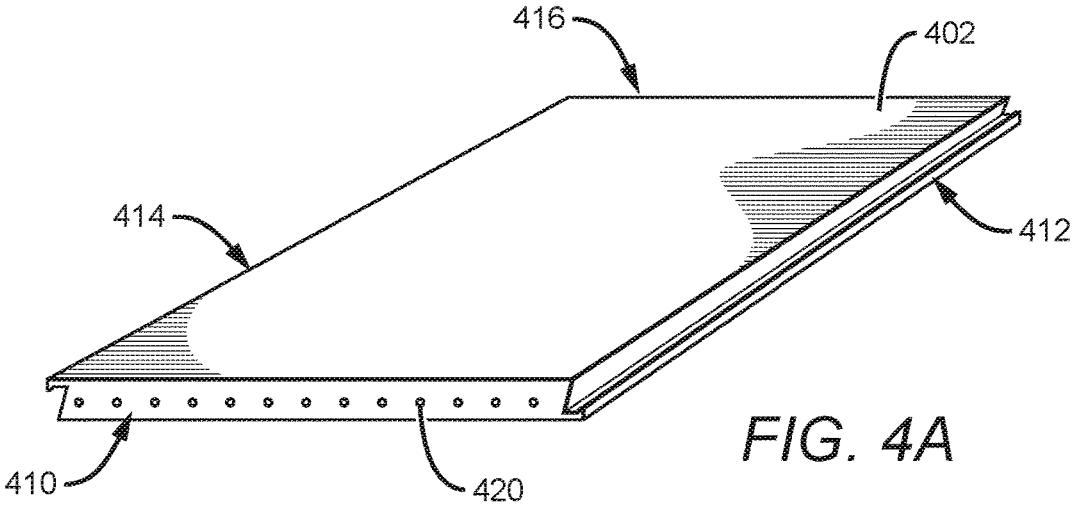
FIGS. 4A-4C illustrate various views of another embodiment of a piece.
Figure 4B:
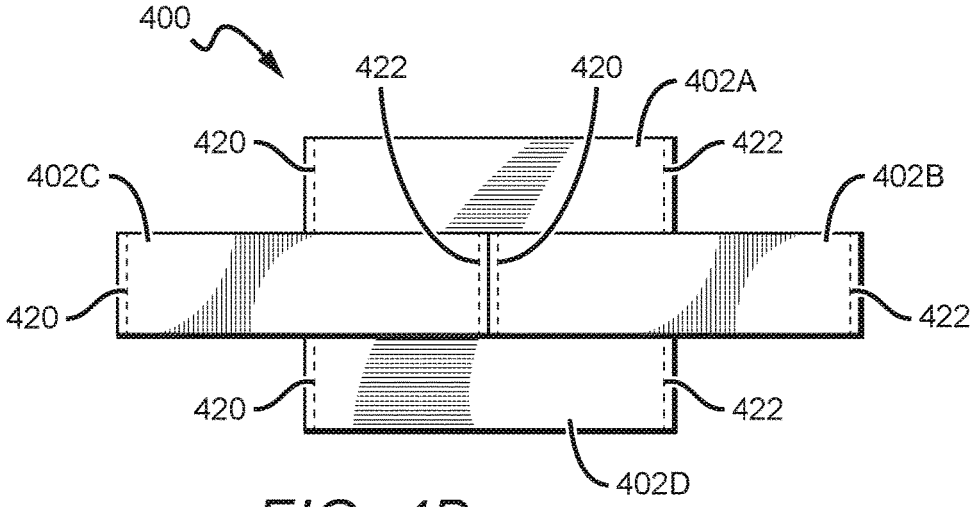
Figure 4C:
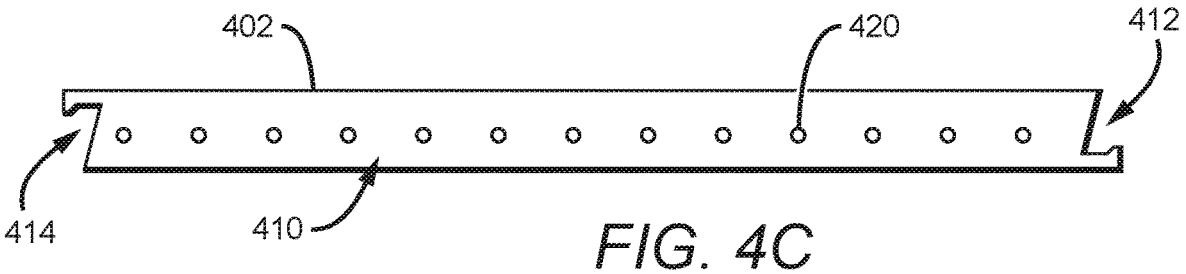

FIGS. 4A-4C illustrate another embodiment of a flooring system 400 for covering a floor or other surface that comprises a set of tiles 402. As shown in FIGS. 4A and 4C, each tile 402 comprises a composite piece having a first side 410, a second side 416, a third side 412, and a fourth side 414 forming a rectangular shape with the first and second sides 410, 416 disposed opposite of each other, and the third and fourth sides 412, 414 disposed opposite of each other. In such arrangement, the third side and fourth sides 412, 414 are each disposed between the first and second sides 410, 416. As discussed above, triangular shapes and other shapes are alternatively contemplated.

The first side 410 preferably comprises a set of magnets 420 embedded or otherwise coupled to the first side 410. Similarly, the second side 416 can comprise a second set of magnets 422 having a polarity that is opposite those of the set of magnets 420.

Tile 402 can include a third side 412 having a first routed edge and a fourth side 414 having a second routed edge. As shown, the first and second routed edges can be complementary to one another, such that a first routed edge of a first tile can connect and interlock with a second routed edge of an adjacent tile. The adjacent tiles may be coupled in an interlocking manner where the edges are placed together and then moved relative to one another to lock the tiles in place. In such embodiments, it is contemplated that the interaction of magnets 420 of one tile and magnets 422 of the adjacent tile can be used to help prevent the first and second sides of the tiles from raising or warping over time by the use of the magnetic coupling with adjacent tiles.

Thus, like the tile shown in FIGS. 2A and 2C, two of the sides (first and second sides) can have a set of magnets or otherwise be magnetized, and the other two sides (third and fourth sides) can have a routed edge that permits interlocking of an adjacent tile.

As shown in FIG. 4B, multiple tiles 402A-402D can be connected to adjacent tiles to form a flooring. For example, tile 402A can be connected to tiles 402C and 402B via the routed edges of those tiles. Likewise, tile 402D can be connected to tiles 402C and 402B via the routed edges of those tiles. Tiles 402B and 402C can be magnetically coupled to one another via magnets 420 and magnets 422, respectively.

Figure 5A:
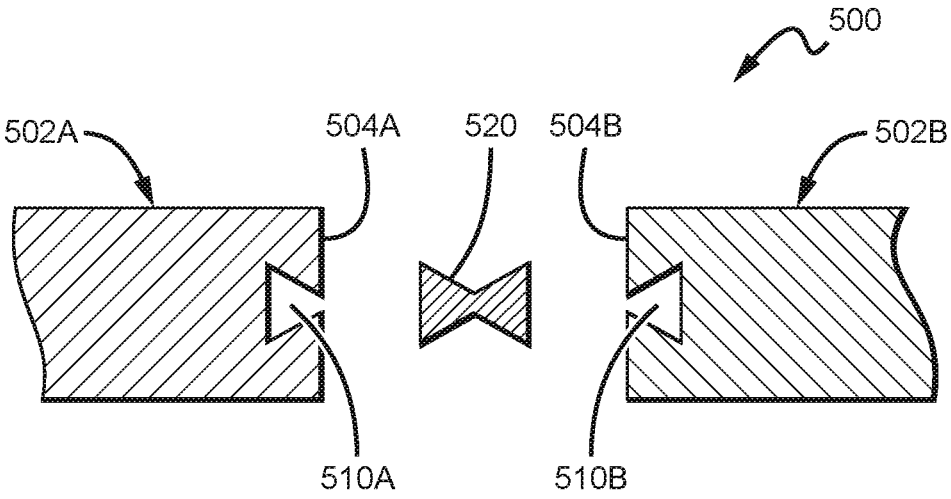
FIGS. 5A-5B illustrate side views of another embodiment of a piece.
Figure 5B:
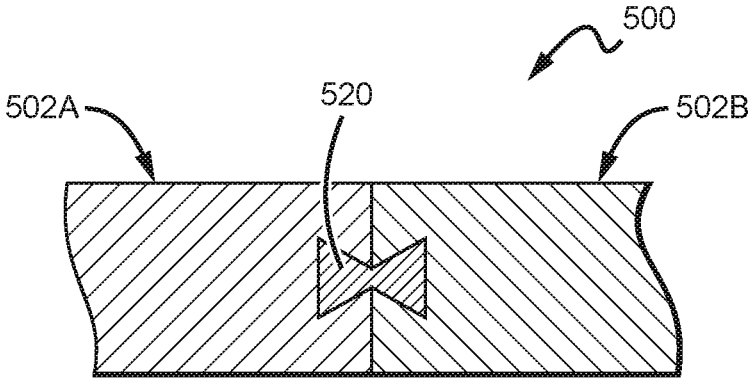

FIGS. 5A-5B illustrate another embodiment of a flooring system 500 for covering a floor or other surface that comprises a set of tiles 502A, 502B. Tile 502A can have a first side 504A with a slot 510A formed in the side 504A. Similarly, tile 502B can have a first side 504B with a slot 510B formed in the side 504B.

Slots 510A, 510B preferably comprises first and second opposing sides that extend between an opening of each slot 510A, 510B on an outer surface of the first side 504A, 504B, respectively, and an inner surface of each slot 510A, 510B. A width or diameter of the inner surface of each slot 510A, 510B is preferably greater than a width or diameter of the opening of each slot 510A, 510B.

As shown, preferably the first and second opposing sides of each slot 510A, 510B are tapered, such that a cross-section of each slot 510A, 510B comprises an isosceles trapezoid shape. In such embodiment, it is contemplated that each slot 510A, 510B is configured to receive a portion of an insert 520.

When the insert 520 is received by both of the slots 510A, 510B, tile 502A and tile 502B are connected to one another.

Alternatively, it is contemplated that the slots 510A, 510B could comprise a T-shape, an L-shape, or other suitable shape, such that a width or diameter of the inner surface of each slot 510A, 510B remains greater than a width or diameter of the opening of each slot 510A, 510B. In such embodiments, it is contemplated that the shape of the insert could be likely varied to an I-shape (for T-shaped slots) or a C-shape (for L-shaped slots), for example.

Although not shown, it is contemplated that each of tiles 502A and 502B can include opposing sides having routed edges that are preferably complementary to one another, such that routed edge of one tile can be connected with routed edge of the adjacent tile.

Figure 6A:
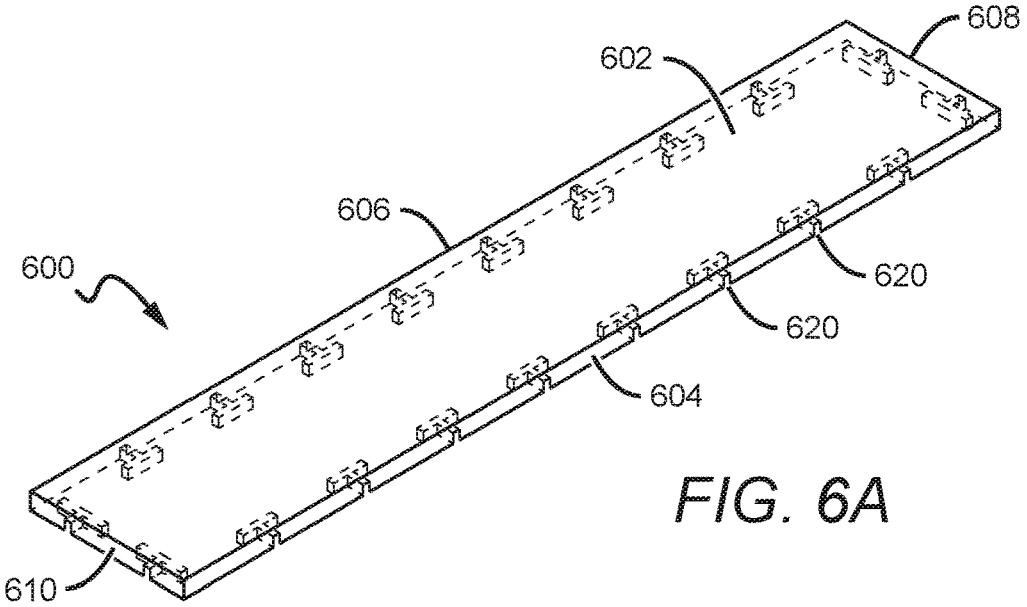
FIGS. 6A-6C illustrate various views of another embodiment of a piece.
Figure 6B:
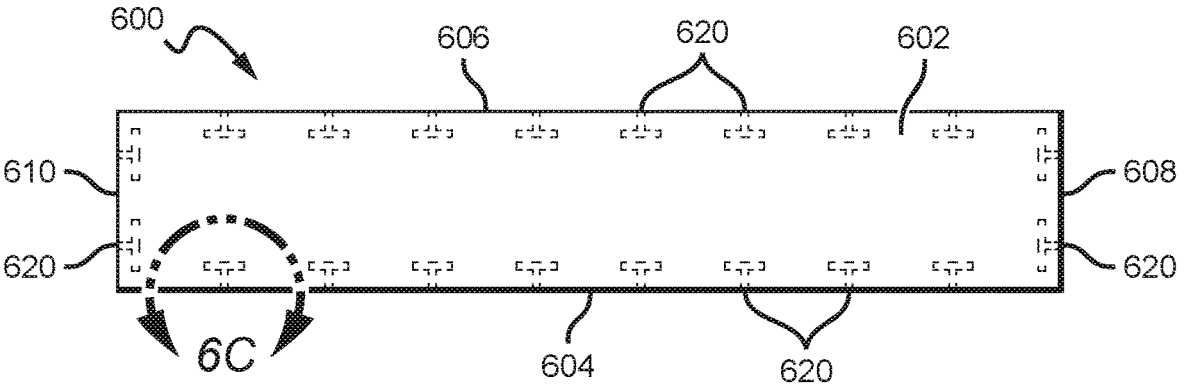
Figure 6C:
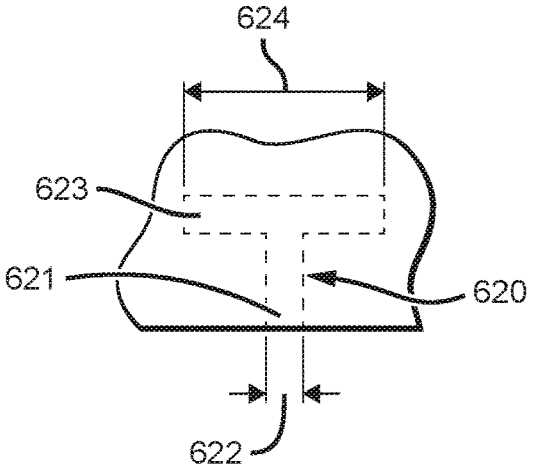

FIGS. 6A-6C illustrate one embodiment for a device 600 for covering a floor or other surface. Device 600 comprises a piece 602 having a first side 604, a second side 606, a third side 608, and a fourth side 610 forming a rectangular shape with the first and second sides 604, 606 disposed opposite of each other, and the third and fourth sides 608, 610 disposed opposite of each other. In such arrangement, the third side 608 and the fourth side 610 are each disposed between the first and second sides 604, 606. Of course, piece 602 could instead have three sides or five or more sides without departing from the scope of the invention herein.

Piece 602 may comprise a composite material or may be formed from solid wood or another material for example. In some embodiments, piece 602 comprises a flooring plank that may or may not be a composite and that can be connected or coupled with other planks to form a decorative flooring surface.

As shown, the first and second sides 604, 606 comprise a plurality of cutouts 620 in a bottom surface of the piece 602 and that are disposed along each of the first and second sides 604, 606. The third and fourth sides 608, 610 may also comprise cutouts 620 in the bottom surface of the piece 602 and that are disposed along each of the third and fourth sides 608, 610. Preferably each of the cutouts are formed in the piece using a router to cut the piece and form the cutout. Each cutout 620 does not extend through the piece such as from the bottom surface to the top surface but only extends into a portion of the piece 602.

As shown best in FIG. 6C, each of the cutouts 620 comprises a first width 622 disposed at an edge of one of the sides 604, 606, 608, 610, and a second width 624 measured at a point away from the edge, and wherein the second width 624 is greater than the first width 622. Each of the cutouts comprises a T-shape, although an L-shape, a trapezoidal shape, and other shapes are contemplated where the second width 624 is greater than the first width 622. It is important that the second width 624 is greater than the first width 622 to ensure the insert is not inadvertently removed from the cutout 620 due to forces acting upon the insert.

Preferably, each of the cutouts 620 is disposed along the third and fourth sides 608, 610 comprises a third width equal to the first width 622 and a fourth width equal to the second width 624. In such embodiments, the fourth width is greater than the third width.

A first end 621 of each cutout 620 is disposed at the edge of one of the sides 604, 606, 608, 610, and a second end 623 of each cutout 620 is disposed away from the edge. Preferably, the first end 621 of the T-shaped cutout 620 comprises the first width 622, and the second end 623 of the T-shaped cutout 620 comprises the second width 624.

Figure 6D:
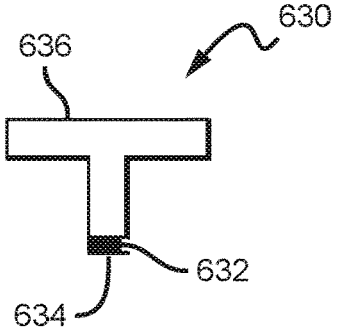
FIG. 6D illustrates one embodiment of an insert.

Each of the cutouts 620 is configured to receive an insert, such as insert 630 shown in FIG. 6D. Insert 630 preferably comprises a T-shape that is similar to the shape of the cutouts 620.

It is especially preferred that each insert 630 comprises a magnet 632 disposed at a first end 634 of the insert opposite of a second end 636 of the insert 630. In this manner, when the insert 630 is disposed within the cutout 620, the magnet 632 is disposed at the first end 621 of the cutout 620. The magnet 632 is preferably embedded in the insert 630 at the first end 634.

In certain embodiments, each of the inserts 630 disposed in cutouts along one of the sides of the piece 602 may be connected together such as via a connecting piece that extends along the side or within a separate routed cutout of the piece.

In this manner, piece 602 can be configured to magnetically couple with up to four adjacent pieces having an identical configuration as that of piece 602.

Preferably, when the inserts are disposed within the cutouts 620, the magnets are arranged such that the first and third sides 604, 608 have a first polarity and the second and fourth sides 606, 610 have an opposite polarity of the first polarity.

Figure 7A:
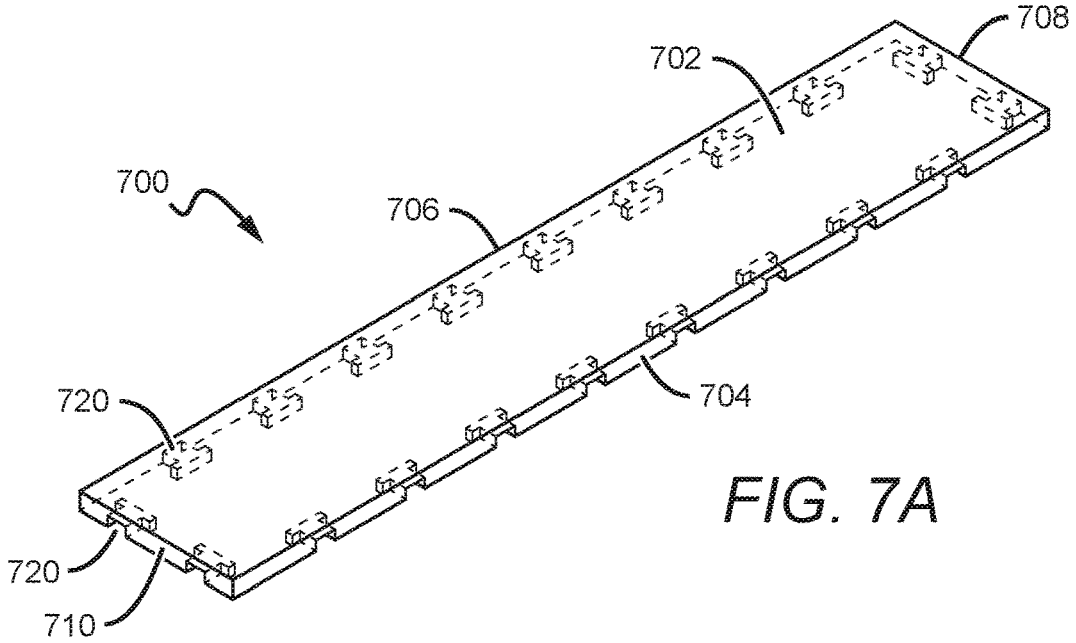
FIGS. 7A-7C illustrate various views of another embodiment of a piece.
Figure 7B:
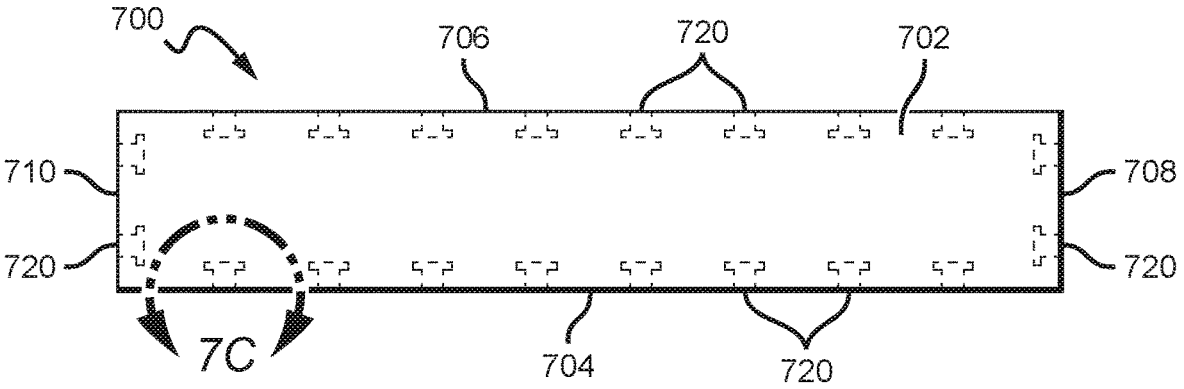
Figure 7C:
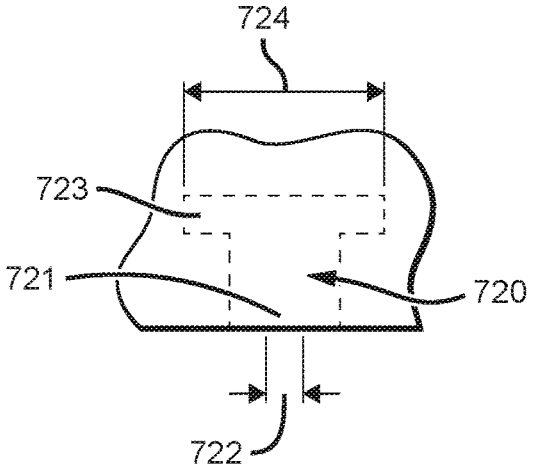

FIGS. 7A-7C illustrate another embodiment for a device 700 for covering a floor or other surface. Device 700 comprises a piece 702 having a first side 704, a second side 706, a third side 708, and a fourth side 710 forming a rectangular shape with the first and second sides 704, 706 disposed opposite of each other, and the third and fourth sides 708, 710 disposed opposite of each other. In such arrangement, the third side 708 and the fourth side 710 are each disposed between the first and second sides 704, 706. Of course, piece 702 could instead have three sides or five or more sides without departing from the scope of the invention herein.

Piece 702 may comprise a composite material or may be formed from solid wood or another material for example. In some embodiments, piece 702 comprises a flooring plank that may or may not be a composite and that can be connected or coupled with other planks to form a decorative flooring surface.

As shown, the first and second sides 704, 706 comprise a plurality of cutouts 720 in a bottom surface of the piece 702 and that are disposed along each of the first and second sides 704, 706. The third and fourth sides 708, 710 may also comprise cutouts 720 in the bottom surface of the piece 702 and that are disposed along each of the third and fourth sides 708, 710. Preferably each of the cutouts are formed in the piece using a router to cut the piece and form the cutout. Each cutout 720 does not extend through the piece such as from the bottom surface to the top surface but only extends into a portion of the piece 702.

As shown best in FIG. 7C, each of the cutouts 720 comprises a first width 722 disposed at an edge of one of the sides 704, 706, 708, 710, and a second width 724 measured at a point away from the edge, and wherein the second width 724 is greater than the first width 722. Each of the cutouts comprises a T-shape, although an L-shape, a trapezoidal shape, and other shapes are contemplated where the second width 724 is greater than the first width 722. It is important that the second width 724 is greater than the first width 722 to ensure the insert is not inadvertently removed from the cutout 720 due to forces acting upon the insert.

Preferably, each of the cutouts 720 is disposed along the third and fourth sides 708, 710 comprises a third width equal to the first width 722 and a fourth width equal to the second width 724. In such embodiments, the fourth width is greater than the third width.

A first end 721 of each cutout 720 is disposed at the edge of one of the sides 704, 706, 708, 710, and a second end 723 of each cutout 720 is disposed away from the edge. Preferably, the first end 721 of the T-shaped cutout 720 comprises the first width 722, and the second end 723 of the T-shaped cutout 720 comprises the second width 724.

Figure 7D:
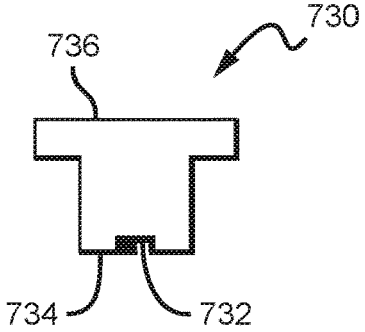
FIG. 7D illustrates another embodiment of an insert.

Each of the cutouts 720 is configured to receive an insert, such as insert 730 shown in FIG. 7D. Insert 730 preferably comprises a T-shape that is similar to the shape of the cutouts 720.

It is especially preferred that each insert 730 comprises a magnet 732 disposed at a first end 734 of the insert opposite of a second end 736 of the insert 730. In this manner, when the insert 730 is disposed within the cutout 720, the magnet 732 is disposed at the first end 721 of the cutout 720. The magnet 732 is preferably embedded in the insert 730 at the first end 734.

In certain embodiments, each of the inserts 730 disposed in cutouts along one of the sides of the piece 702 may be connected together such as via a connecting piece that extends along the side or within a separate routed cutout of the piece.

In this manner, piece 702 can be configured to magnetically couple with up to four adjacent pieces having an identical configuration as that of piece 702.

Preferably, when the inserts are disposed within the cutouts 720, the magnets are arranged such that the first and third sides 704, 708 have a first polarity and the second and fourth sides 706, 710 have an opposite polarity of the first polarity.

Figure 8A:
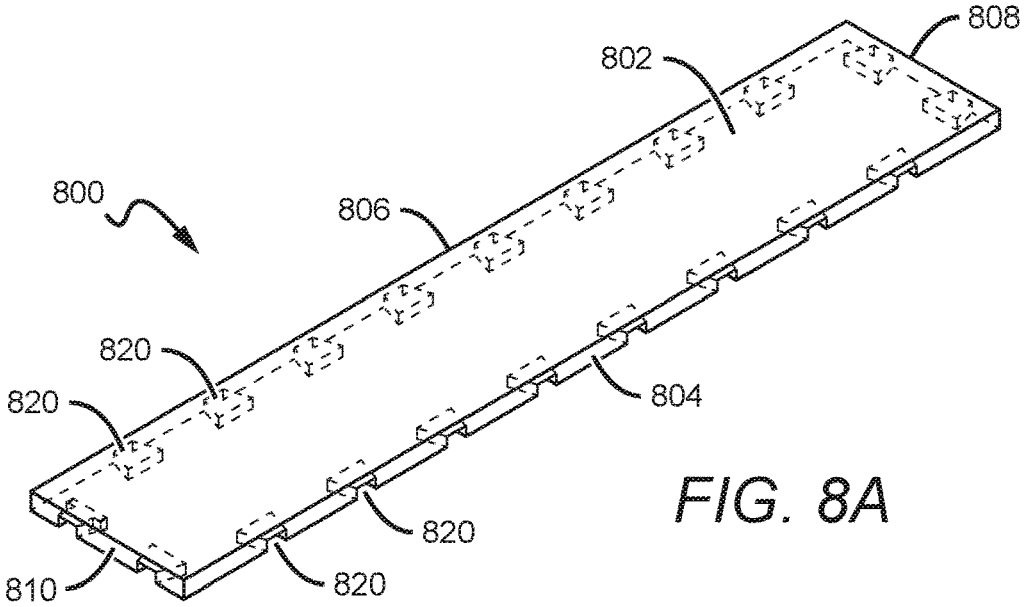
FIGS. 8A-8C illustrate various views of another embodiment of a piece.
Figure 8B:
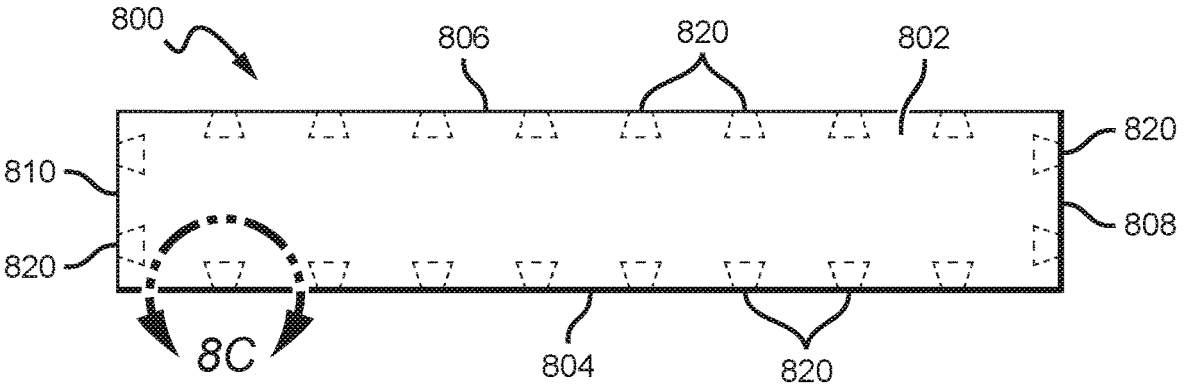
Figure 8C:
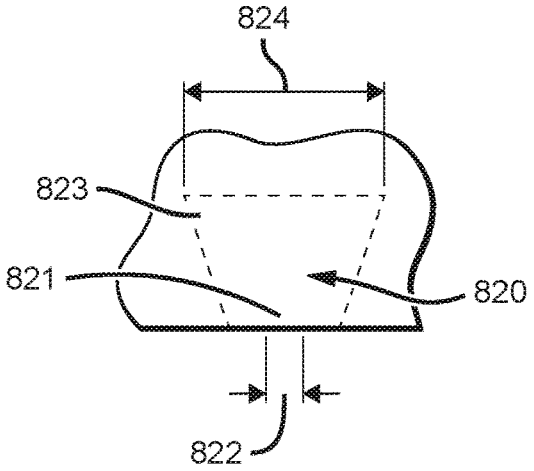

FIGS. 8A-8C illustrate another embodiment for a device 800 for covering a floor or other surface. Device 800 comprises a piece 802 having a first side 804, a second side 806, a third side 808, and a fourth side 810 forming a rectangular shape with the first and second sides 804, 806 disposed opposite of each other, and the third and fourth sides 808, 810 disposed opposite of each other. In such arrangement, the third side 808 and the fourth side 810 are each disposed between the first and second sides 804, 806. Of course, piece 802 could instead have three sides or five or more sides without departing from the scope of the invention herein.

Piece 802 may comprise a composite material or may be formed from solid wood or another material for example. In some embodiments, piece 802 comprises a flooring plank that may or may not be a composite and that can be connected or coupled with other planks to form a decorative flooring surface.

As shown, the first and second sides 804, 806 comprise a plurality of cutouts 820 in a bottom surface of the piece 802 and that are disposed along each of the first and second sides

804, 806. The third and fourth sides 808, 810 may also comprise cutouts 820 in the bottom surface of the piece 802 and that are disposed along each of the third and fourth sides 808, 810. Preferably each of the cutouts are formed in the piece using a router to cut the piece and form the cutout. Each cutout 820 does not extend through the piece such as from the bottom surface to the top surface but only extends into a portion of the piece 802.

As shown best in FIG. 8C, each of the cutouts 820 comprises a first width 822 disposed at an edge of one of the sides 804, 806, 808, 810, and a second width 824 measured at a point away from the edge, and wherein the second width 824 is greater than the first width 822. Each of the cutouts comprises a trapezoidal shape, although an L-shape, a T-shape, and other shapes are contemplated where the second width 824 is greater than the first width 822. It is important that the second width 824 is greater than the first width 822 to ensure the insert is not inadvertently removed from the cutout 820 due to forces acting upon the insert.

Preferably, each of the cutouts 820 is disposed along the third and fourth sides 808, 810 comprises a third width equal to the first width 822 and a fourth width equal to the second width 824. In such embodiments, the fourth width is greater than the third width.

A first end 821 of each cutout 820 is disposed at the edge of one of the sides 804, 806, 808, 810, and a second end 823 of each cutout 820 is disposed away from the edge. Preferably, the first end 821 of the trapezoidal-shaped cutout 820 comprises the first width 822, and the second end 823 of the trapezoidal-shaped cutout 820 comprises the second width 824.

Figure 8D:
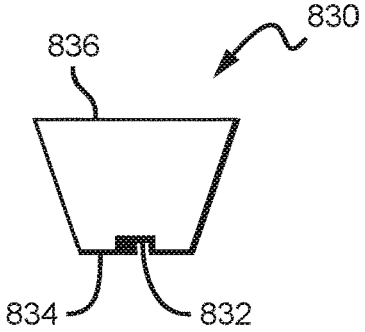
FIG. 8D illustrates another embodiment of an insert.

Each of the cutouts 820 is configured to receive an insert, such as insert 830 shown in FIG. 8D. Insert 830 preferably comprises a trapezoidal-shape that is similar to the shape of the cutouts 820.

It is especially preferred that each insert 830 comprises a magnet 832 disposed at a first end 834 of the insert opposite of a second end 836 of the insert 830. In this manner, when the insert 830 is disposed within the cutout 820, the magnet 832 is disposed at the first end 821 of the cutout 820. The magnet 832 is preferably embedded in the insert 830 at the first end 834.

In certain embodiments, each of the inserts 830 disposed in cutouts along one of the sides of the piece 802 may be connected together such as via a connecting piece that extends along the side or within a separate routed cutout of the piece.

In this manner, piece 802 can be configured to magnetically couple with up to four adjacent pieces having an identical configuration as that of piece 802.

Preferably, when the inserts are disposed within the cutouts 820, the magnets are arranged such that the first and third sides 804, 808 have a first polarity and the second and fourth sides 806, 810 have an opposite polarity of the first polarity.

FIGS. 9A-9C illustrate one embodiment for a device 900 for covering a floor or other surface. Device 900 comprises a piece 902 having a first side 904, a second side 906, a third side 908, and a fourth side 910 forming a rectangular shape with the first and second sides 904, 906 disposed opposite of each other, and the third and fourth sides 908, 910 disposed opposite of each other. In such arrangement, the third side 908 and the fourth side 910 are each disposed between the first and second sides 904, 906. Of course, piece 902 could instead have three sides or five or more sides without departing from the scope of the invention herein.

Piece 902 may comprise a composite material or may be formed from solid wood or another material for example. In some embodiments, piece 902 comprises a flooring plank that may or may not be a composite and that can be connected or coupled with other planks to form a decorative flooring surface.

As shown, the first and second sides 904, 906 comprise a plurality of cutouts 920 in a bottom surface of the piece 902 and that are disposed along each of the first and second sides 904, 906. The third and fourth sides 908, 910 may also comprise cutouts 920 in the bottom surface of the piece 902 and that are disposed along each of the third and fourth sides 908, 910. Preferably each of the cutouts are formed in the piece using a router to cut the piece and form the cutout. Each cutout 920 does not extend through the piece such as from the bottom surface to the top surface but only extends into a portion of the piece 902.

As shown best in FIG. 9C, each of the cutouts 920 comprises a first width 922 disposed at an edge of one of the sides 904, 906, 908, 910, and a second width 924 measured at a point away from the edge, and wherein the second width 924 is greater than the first width 922. Each of the cutouts comprises a T-shape, although an L-shape, a trapezoidal shape, and other shapes are contemplated where the second width 924 is greater than the first width 922. It is important that the second width 924 is greater than the first width 922 to ensure the insert is not inadvertently removed from the cutout 920 due to forces acting upon the insert.

Preferably, each of the cutouts 920 is disposed along the third and fourth sides 908, 910 comprises a third width equal to the first width 922 and a fourth width equal to the second width 924. In such embodiments, the fourth width is greater than the third width.

A first end 921 of each cutout 920 is disposed at the edge of one of the sides 904, 906, 908, 910, and a second end 923 of each cutout 920 is disposed away from the edge. Preferably, the first end 921 of the T-shaped cutout 920 comprises the first width 922, and the second end 923 of the T-shaped cutout 920 comprises the second width 924.

Each of the cutouts 920 is configured to receive an insert 930. Insert 930 preferably comprises a H-shape or I-shape, such that a portion of the insert 930 can be disposed within one of the cutouts 920. Of course, the specific shape of the insert 930 will depend on the shape of the cutouts 920. FIGS. 9A-9B illustrate some of the cutouts 920 having an insert 930 disposed within the cutout with others of the cutouts without an insert.

As shown in FIGS. 9A-9C, a first portion of each insert 930 is disposed in one of the cutouts 920 with a second portion of each insert 930 extending away from the edge of the piece 902. In such embodiments, the second portion of each insert 930 is configured to be received in an adjacent piece having a second plurality of cutouts along a side that abuts the piece 902. In this manner, piece 902 can be physically coupled with up to four adjacent pieces via the inserts 930 to form the surface.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value with a range is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A device that can be interconnected with other devices to form a flooring, comprising:

a composite or engineered flooring plank having an elongated, rectangular shape with first, second, third and fourth sides, wherein the first and second sides are disposed opposite of each other, and the third and fourth sides are disposed opposite of each other, and wherein the flooring plank comprises a length defined by the third and fourth sides, a width defined by the first and second side, and a height defined as a distance between a bottom surface and a top surface of the flooring plank;

wherein the first and second sides comprise a plurality of cutouts in the bottom surface of the flooring plank that extend through only a portion of the height of the flooring plank and do not extend entirely through the flooring plank to the top surface, and that are disposed along each of the first and second sides;

wherein each of the cutouts comprises a first width disposed at an edge of the first or second side, and a second width measured at a point away from the edge, and wherein the second width is greater than the first width;

a plurality of inserts that each comprises a varying width such that a first end has a width that is greater than a width of a second end of the insert, and wherein each of the inserts comprises a magnet fixed in place relative to the insert and disposed at the second end of the insert; and wherein each of the cutouts is configured to receive one of a plurality of inserts that is disposed within the cutout.

2. The device of claim 1, further comprising:

a second plurality of cutouts in the bottom surface of the flooring plank that extend through only a portion of the height of the flooring plank and do not extend entirely through the flooring plank to the top surface, and that are disposed along each of the third and fourth sides;

wherein each of the second plurality of cutouts comprises a third width disposed at an edge of the third or fourth side, and a fourth width measured at a point away from the edge, and wherein the fourth width is greater than the third width;

a second plurality of inserts that each comprises a varying width such that a first end has a width that is greater than a width of a second end of the insert, and wherein each of the inserts comprises a magnet disposed at the second end; and wherein each of the second plurality of cutouts is configured to receive one of the second plurality of inserts that is disposed within the cutouts.

3. The device of claim 2, wherein each of the magnets disposed at the edge of the third side has a first polarity, and wherein each of the magnets disposed at the edge of the fourth side has a second polarity that is opposite the first polarity.

4. The device of claim 1, wherein each of the cutouts comprises a routed cutout on the bottom surface of the flooring plank.

5. A flooring system of interconnected planks covering a floor, comprising:

a plurality of flooring planks, wherein each of the flooring planks comprises:

an elongated, rectangular shape having first, second, third and fourth sides, wherein the first and second sides are disposed opposite of each other, and the third and fourth sides are disposed opposite of each other, and wherein each flooring plank comprises a length defined by the third and fourth sides, a width defined by the first and second side, and a height defined as a distance between a bottom surface and a top surface of the flooring plank;

wherein each of the first, second, third and fourth sides comprise a plurality of routed cutouts in the bottom surface of the flooring plank that extend through only a portion of the height of the flooring plank and do not extend entirely through the flooring plank to the top surface, and that are disposed along each of the sides;

wherein each of the routed cutouts comprises a first width disposed at a first end, and a second width measured at a point away from the first end, and wherein the second width is greater than the first width; and wherein each of the routed cutouts is configured to receive one of a plurality of inserts that is at least partially disposed within the routed cutout, wherein each of the inserts comprises a varying width such that a first end has a width that is greater than a width of a second end of the insert, and wherein each insert comprises a magnet fixed in place relative to the insert and disposed at the second end of the insert;

wherein each of the plurality of flooring planks is configured to magnetically couple with up to four adjacent ones of the plurality of flooring planks to form a flooring.

6. The flooring system of claim 5, wherein the magnet is embedded within each of the inserts at the first end.

* * * * *